US009718074B2

(12) United States Patent
Deng et al.

(10) Patent No.: US 9,718,074 B2
(45) Date of Patent: Aug. 1, 2017

(54) SPRAY BOTTLE AND SPRAY BOTTLE CAP THEREOF

(71) Applicant: SHENZHEN BONA MEDICINAL PACKAGING MATERIAL CO., LTD., Shenzhen (CN)

(72) Inventors: Yunhua Deng, Shenzhen (CN); Huashun Xing, Shenzhen (CN)

(73) Assignee: SHENZHEN BONA PHARMA TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/902,701

(22) PCT Filed: Sep. 19, 2014

(86) PCT No.: PCT/CN2014/086955

§ 371 (c)(1),
(2) Date: Jan. 4, 2016

(87) PCT Pub. No.: WO2016/015372

PCT Pub. Date: Feb. 4, 2016

(65) Prior Publication Data

US 2017/0144178 A1 May 25, 2017

(30) Foreign Application Priority Data

Jul. 31, 2014 (CN) ..... 2014 1 0373859
Aug. 8, 2014 (WO) ..... PCT/CN2014/083969

(51) Int. Cl.

| | |
|---|---|
| ***B67B 1/00*** | (2006.01) |
| ***B05B 11/00*** | (2006.01) |
| ***B65D 41/62*** | (2006.01) |

(52) U.S. Cl.
CPC ..... *B05B 11/3059* (2013.01); *B05B 11/3047* (2013.01); *B65D 41/62* (2013.01)

(58) Field of Classification Search
CPC .. B05B 11/3059; B05B 11/3047; B65D 41/62
(Continued)

(56) References Cited

U.S. PATENT DOCUMENTS 4,179,049 A 12/1979 Umstead
4,830,224 A * 5/1989 Brison ..... B05B 11/3059 222/153.06

(Continued)

FOREIGN PATENT DOCUMENTS

CN 2875418 Y 3/2007
CN 203183445 U 9/2013
CN 203359205 U 12/2013

*Primary Examiner* — Patrick M Buechner
*Assistant Examiner* — Jeremy W Carroll
(74) *Attorney, Agent, or Firm* — Global IP Services; Tianhua Gu

(57) ABSTRACT

A spray bottle cap comprising a base lid, a pressing head and a protective cap. An upper end of an inner wall of the base lid is provided with a first limit rib and a first guide groove penetrating the first limit rib. The pressing head connects to the upper end of the base lid, and comprises a outlet rob, a pressing handle and a connection portion, where the outlet rod is provided with an outer thread, the lower end of the connection portion is provided with a first limit flange and a protrusion portion, and the pressing handle is provided with an anti-reversion snap parent body; the first limit flange is arranged under the first limit rib, and the protrusion portion is up-down slidable along the first guide groove and is supportable on the upper end face of the base lid. The protection cap is a double-layer structure covering the outside of the outlet rod.

17 Claims, 9 Drawing Sheets

(58) Field of Classification Search
USPC ..... 222/153.1, 153.04, 153.13, 153.14
See application file for complete search history.

(56) References Cited

U.S. PATENT DOCUMENTS

| | | | | |
|---|---|---|---|---|
| 6,112,921 | A | 9/2000 | Robinson | |
| 6,543,650 | B1 * | 4/2003 | Sprick | B65D 47/242 222/153.02 |
| 2003/0150876 | A1 * | 8/2003 | Walters | B05B 11/3059 222/153.13 |
| 2016/0243319 | A1 * | 8/2016 | Szymiczek | B05B 11/0032 |

* cited by examiner

SPRAY BOTTLE AND SPRAY BOTTLE CAP THEREOF

CROSS REFERENCE TO RELATED PATENT APPLICATION

The present application is the US national stage of PCT/CN2014/086955 filed on Sep. 19, 2014, which claims the priority of the Chinese patent applications No. 201410373859.7 filed on Jul. 31, 2014 and PCT/CN2014/083969 filed on Aug. 8, 2014, which applications are incorporated herein by reference.

BACKGROUND OF THE PRESENT INVENTION

Field of Invention

The present invention relates to the technical field of a spray bottle, and particularly relates to a spray bottle and a bottle cap thereof.

Description of Related Arts

The spray bottle has been widely used in various industries and technical fields, such as the fields of chemical engineering, medicine, food and the like. According to the actual requirement, some spray bottles have relative high material requirements, while the use of the spray bottle cap is limited to seal the liquid inside, or limited to the dust suppression effect. In medicine, there are often some liquid medicines, such as cough syrup, rhinitis spray, beriberi spray and the like, and the spray bottle for containing those liquid medicines should be configured with not only an inner lid but also an outer lid, where the inner lid is capable of covering the opening thereof and spraying liquid, and the outer lid is capable of covering the outlet port of the inner lid. Also, the outer lid should not only serve to the dust suppression effect, but non-easy falling out, lest it is opened and accidental ingested by an infant, which may become a life-threatening risk. In the field of chemical engineering of wash product line and cosmetic line, such as dish detergent, laundry detergent, shampoo, facial cleanser and the like, for the sake of health, convenience as well as security, currently, the liquid packaging form that the outlet port of the inner lid is further provided with an outer lid has been increasingly adopted.

In the spray bottle cap consisting of an inner lid and an outer lid of the prior art, it is often provided with a structure between the outer wall of the inner lid and the inner wall of the outer lid, where the structure is fitted by an arc-shaped groove and an arc-shaped boss to achieve the connection therebetween. If the fit is relative tight, it requires larger power to pull out the outer lid from the inner lid, which is unfavorable for the old; if the fit is relative loose, the outer lid is apt to fall off from the inner lid, with the result of poor safety. Some outer cap bodies and inner cap bodies are in the form of threaded connection, the structure of which is apt to be opened by infants, with the result of poor safety as well. The U.S. patent (U.S. Pat. No. 6,112,921) has disclosed a child-resistant closure, which comprises an upper end comprising an outer wall and an inner wall connected by an upper surface; the inner wall is provided with an inner thread matched with an outer thread of a container opening; the outer wall is provided with a notch; the lower end of the inner wall is provided an extended wall opposite to the notch of the outer wall; a shoulder of the container is provided with a sub-triangular boss, when the closure is covered, the inner thread of the inner wall of the closure is screwed with the outer thread of the container opening, the outer wall and the extended wall of the lower end of the inner wall is inserted by the sharp corner of the boss of the container shoulder, and is transformed under the action of the boss, and is recovered until the extended wall of the lower end of the inner wall is departed from the boss. When there is a need to open the closure, firstly the extended wall is pinched to make it transformed, then a gap larger than the width of back-end of the boss is formed between the extended wall and the outer wall, so that the closure is able to be opened. Such structure is safe and is unable to be opened by a child, whereas the operation is relative laborious, and is also difficult for the old to open, thereby causing inconvenient use.

SUMMARY OF THE PRESENT INVENTION

In view of the above disadvantages of the prior art, the technical problem to be solve in the present invention is to provide a spray bottle and cap thereof, which is safe, easy to operate, and convenient in use, thereby overcoming the disadvantages of the prior art.

In order to solve the above technical problem, the present invention provides a spray bottle cap, which comprises:

a base lid, an upper end of an inner wall of the base lid is provided with a first limit rib and a first guide groove penetrating the first limit rib;

a pressing head connecting to the upper end of the base lid; the pressing head comprises a outlet rod, a pressing handle and a connection portion, an outer wall of the outlet rod is provided with an outer thread; inside the connection portion is provided with a first limit flange and a protrusion portion, the protrusion portion is located above the first limit flange; the pressing handle is provided with an anti-reversion snap parent body; the first limit flange of the connection portion is arranged under the first limit rib of the base lid, the protrusion portion is up-down slidable along the first guide groove of the base lid;

a protective cap covering the outside of the outlet rod; a lower end of the protective cap is a double-layer structure comprising an outer ring of the protective cap and an inner ring of the protective cap; an inner wall of the inner ring of the protective cap is provided with an inner thread matched with the outer thread of the outlet rod, and an lower end of an inner wall of the outer ring of the protective cap is provided with an anti-reversion snap daughter body matched with the anti-reversion snap parent body.

Preferably, a side wall of the connection portion is double-layer structure comprising an outer ring of the connection portion and an inner ring of the connection portion, the first limit flange is arranged at a lower end of the inner ring of the connection portion.

Preferably, the pressing head is a split-type structure, which consists of a pressing head body and a bearing seat.

Preferably, the anti-reversion snap parent body is formed by two adjacent bosses and a card slot located between the two bosses, where the two adjacent bosses are arranged in a circumferential direction; the anti-reversion snap daughter body is the boss arranged at the lower end of the inner wall of the outer ring of the protective cap, and the boss is matched with the card slot.

Preferably, the two adjacent bosses are fan-shape bosses, and the side faces of the two adjacent bosses being away from the card slot are arced surfaces.

Preferably, an upper corner angle of the first limit rib is provided with a chamfer, and a lower corner angle of the first limit flange is provided with a chamfer.

Preferably, the inner wall of the base lid is a shape of stepped holes of lower large-upper small, and comprises a light aperture section, an anti-reversion inner ratchet section, a screw hole section and an outlet section from the lower to the upper side.

Preferably, inside the outlet section is provided with a first neck bushing, where the lower end of the first neck bush is integrally connected to the lower end of the outlet section, and an inner wall of the first neck bush is provided with a ring of sprayer positioning rib.

More preferably, an outer wall of the first neck bush is provided with a third positioning boss, and the inner wall of the pressing head is provided with a fourth positioning boss; when the pressing head is rotating against the base lid, the fourth positioning boss is placed against the third positioning boss.

More preferably, inside the first neck bush is further provided with a length of guide bush extended upward, a lower end of the guide bush is integrally connected to the inner wall of the first neck bush, and an upper end of the guide bush is inserted in an inner cavity of the outlet rod.

Preferably, inside the outlet port of the outlet rod is provided a second neck bush for connecting to an outlet core of the sprayer, and an upper end of the second neck bush is integrally connected to the inner wall of the outlet rod.

Preferably, the outer wall of the base lid is provided with a first alignment reference mark and the outer wall of the connection portion is also provided with a second alignment reference mark.

Preferably, the thread matched between the inner ring of the protective cap and the outlet rod has two sections uniformly distributed along the circumference; there are two anti-reversion snap parent bodies and two anti-reversion snap daughter bodies, which are respectively arranged between the two sections of the threads.

Preferably, the protrusion portion may be the first guide boss arranged at the outer wall of the inner ring of the connection portion.

Preferably, an upper head face of the base lid is provided with a first positioning boss, where the first positioning boss and the first guide groove are arranged in a same circumference.

Preferably, the protrusion portion further may be the second positioning boss arranged between the inner ring and the outer ring of the connection portion.

The present invention further provides a spray bottle comprising a bottle body and a sprayer, where the bottle body is connected with the above spray bottle cap.

As stated, the spray bottle and the spray bottle cap have the following beneficial effects:

1. When in a closed-lid state, under the combined action of the match of the anti-reversion snap and the thread, the protective cap and the pressing head are locked and are less to disengage; the protrusion portion of the pressing head may act against the upper head face of the base lid, thereby avoiding to be pressed downward and preventing the liquid leakage in the closed-lid state, with the result of good security. When requiring for liquid extraction, the protective cap is pressed downward to deform the outer ring of the protective cap, so that the parent body and the daughter body of the anti-reversion snap is separated; in the meanwhile, the protective cap is rotated to loosen the thread match between the protective cap and the pressing head, then the protective cap is removed; after that, the pressing head is rotated to make the protrusion portion insert in the first guide groove of the base lid and the pressing head may be pressed downward by now to realize the liquid extraction, which is labor-saving in operation and convenience in use.

2. The present invention has the advantages of fine appearance and difficult damage with the double-layer structure of the side wall of the connection portion.

3. Each part is simple in structure and convenient in manufacture with the split-type structure of the pressing head, with the result of low manufacturing cost.

4. Because of the arrangement of the position boss, in the closed-lid state, the protrusion portion of the pressing head can be reliably positioned in the position deviated away from the first guide groove, thereby further decreasing the pressing probability of the pressing head, and further improving the security of the present invention as well.

5. Because of the arrangement of the alignment reference marks on the base lid and the pressing head, the users enable to conveniently align the protrusion portion of the pressing head with the first guide groove of the base lid, so that the present invention is much more convenience in use.

Illustrations of reference numbers

Figure 1:
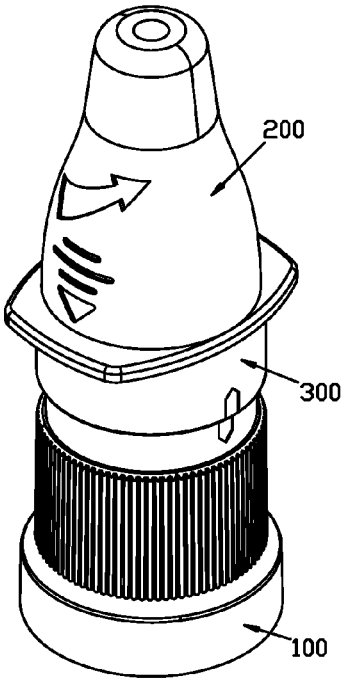
FIG. 1 is shown to a schematic perspective view of a spray bottle cap in accordance with the present invention.

| | | | |
|---|---|---|---|
| 1 | spray bottle cap | 2 | bottle body |
| 3 | sprayer | 3a | outlet core |
| 3b | inlet core | 3c | reset spring |
| 3d | check valve | 100 | base lid |
| 110 | light aperture section | 120 | anti-reversion inner ratchet section |
| 130 | screw hole section | 140 | outlet section |
| 141 | first alignment reference mark | 142 | first limit rib |
| 143 | first guide groove | 144 | first neck bush |
| 144a | sprayer positioning rib | 145 | first positioning boss |
| 146 | guide bush | 147 | third positioning boss |
| 200 | protective cap | 201 | pressing mark |
| 202 | rotation mark | 210 | outer ring of the protective cap |
| 211 | anti-reversion snap daughter body | 220 | inner ring of the protective cap |
| 221 | inner thread | 300 | pressing head |
| 310 | bearing seat | 311 | anti-reversion snap parent body |
| 311a | boss of the anti-reversion snap parent body | 311b | card slot |
| 312 | outer ring of the connection portion | 313 | pressing handle |
| 314 | first positioning rib | 315 | centre hole of the pressing handle |
| 316 | second positioning boss | 317 | second alignment reference mark |
| 320 | pressing head body | 321 | inner ring of the connection portion |
| 321a | first limit flange | 321b | first guide boss |
| 321c | first positioning groove | 321d | second positioning groove |
| 322 | outlet rod | 322a | outer thread |
| 322b | second neck bush | 330 | connection portion |
| 323 | fourth positioning boss | | |

DETAILED DESCRIPTION OF THE PREFERRED EMBODIMENTS

The embodiment modes of the present invention are described hereunder through specific examples, and persons skilled in the art may easily understand other advantages and efficacies of the present invention from the contents disclosed in the present description.

Please refer to FIG. 1 to FIG. 9. It should be known that the form, the scale, the size and the like shown in the drawings attached in this specification are all simply used to match with the content exposed by the specification for the skilled in the art understanding and reading, but not used to limit qualifications when the invention may be implemented. Meanwhile, terms such as "up", "down", "left", "right" and the like cited in this specification are also simply for clearness of the description but not used to limit the scope implemented by the invention. The change or the adjustment of the relative relation should also be seen as the scope of the invention when there is no substantial alteration in the technical content.

Owing to the spray bottles for medicine and chemical wash product, the opening or closing actions therefor are either laborious in operation, non-easy for opening, which is inconvenience for old, or easy for opening but poor in security, which is likely to be opened and accidental ingested by infants. The inventors of the present invention design a spray bottle and a bottle cap thereof, which are provided with a screw-thread fit between a pressing head and a protective cap, as well as an anti-reversion snap structure for unlocking the pressing head and the protective cap by pressing action, so that the protective cap is not only reliably connected but also easy for opening. By designing a protrusion portion for the pressing head that enables to push against the upper face of the base lid, the pressing head avoids to be pressed downward when the spray bottle is in closed-lid state, thereby preventing the liquid leakage in the closed-lid state, with the result of good security. Also, by designing a first guide groove for the base lid, the protrusion portion of the pressing head enables to up-down slide along the first guide groove of the base lid to realize the extraction of liquid, which is labor-saving and convenience in operation.

Hereinafter, the spray bottle and the bottle cap thereof will be specifically illustrated in accordance with specific embodiments.

As shown in FIG. 1, the spray bottle of the present invention is made of plastic, or other elastically deformable materials, and comprises a base lid 100, a protective cap 200 and a pressing head 300.

Figure 4A:
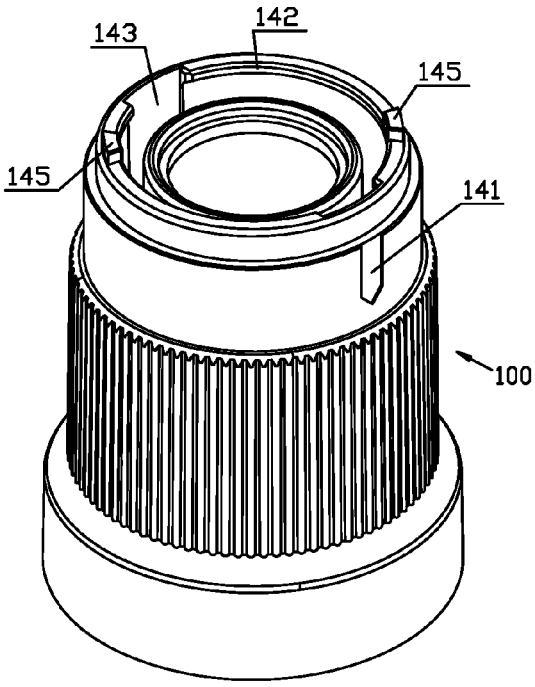
FIG. 4*a* is shown to a schematic perspective view of a base lid of a spray bottle cap in accordance with the present invention.
Figure 4B:
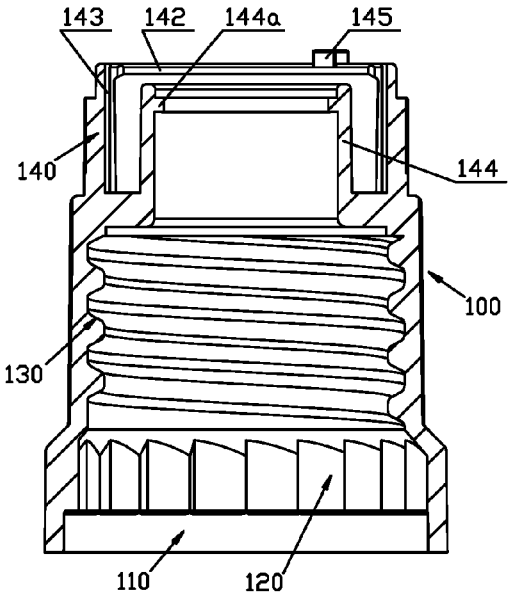
FIG. 4*b* is shown to a front schematic cross-sectional view of a base lid of a spray bottle cap in accordance with the present invention.
Figure 4C:
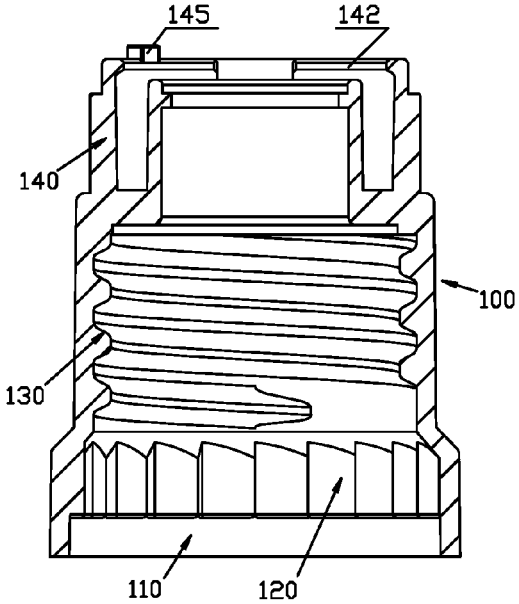
FIG. 4*c* is shown to a side schematic cross-sectional view of a base lid of a spray bottle cap in accordance with the present invention.

As shown in FIGS. 4*a* to 4*c*, the inner wall of the base lid 100 is a shape of stepped holes of lower large-upper small, and comprises a light aperture section 110, an anti-reversion inner ratchet section 120, a screw hole section 130 and an outlet section 140 from the lower to the upper side. The upper end of the inner wall of the outlet section 140 is provided with a first limit rib 142; the inner wall of the outlet section 140 is also provided with a first guide groove 143 penetrating the first limit rib 142. The upper end face of the outlet section 140 is also provided with a first limit boss 145 configured in a same circumference with the first guide groove 143.

Figure 5A:
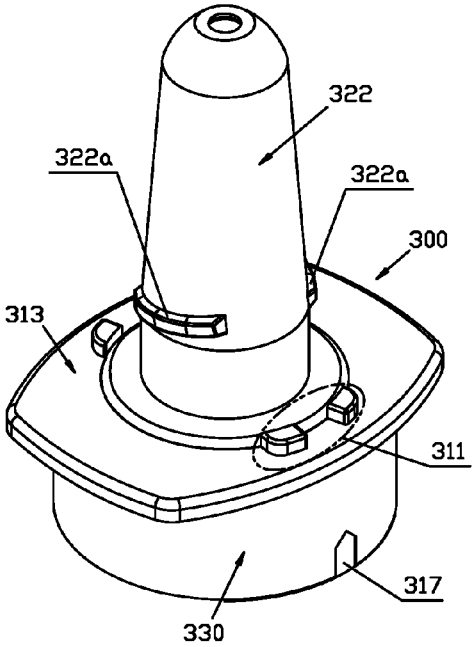
FIG. 5*a* is shown to a schematic perspective view of a pressing head of a spray bottle cap in accordance with the present invention.
Figure 5B:
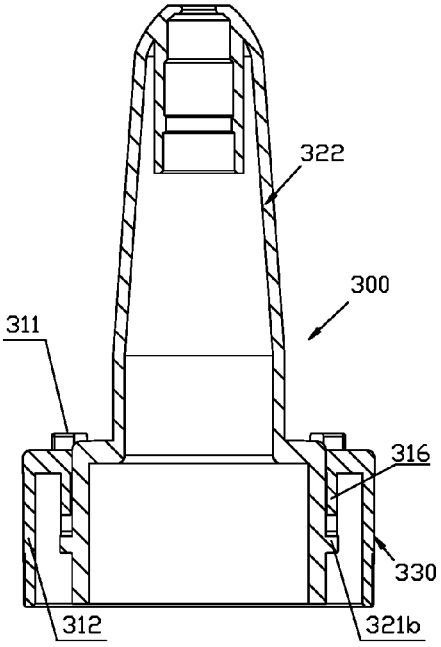
FIG. 5*b* is shown to a front schematic cross-sectional view of a pressing head of a spray bottle cap in accordance with the present invention.
Figure 5C:
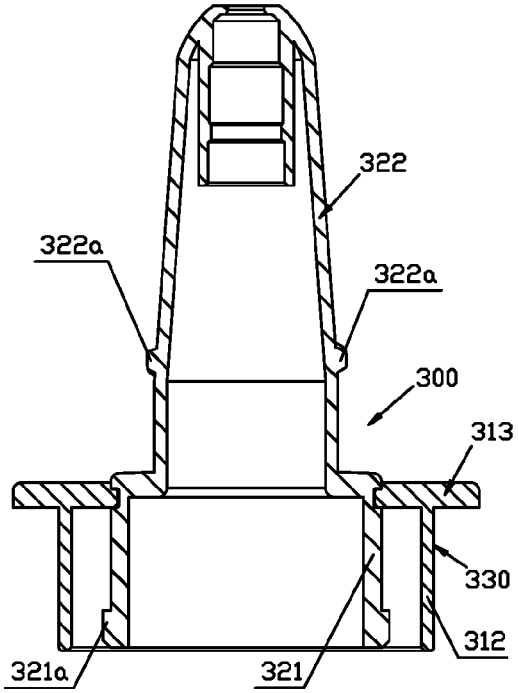
FIG. 5*c* is shown to a side schematic cross-sectional view of a pressing head of a spray bottle cap in accordance with the present invention.

As shown in FIGS. 5*a* to 5*c*, the pressing head 300 comprises a outlet rod 322, a pressing handle 313 and a connection portion 330 located below the pressing handle 313, where an outer wall of the outlet rod 322 is provided with an outer thread 322*a*; a lower end of the connection portion 330 is provided with a first limit flange 321*a* and a first guide boss 321*b*, where the first guide boss 321*b* is located above the first limit flange 321*a*; the pressing handle 313 is provided with an anti-reversion snap parent body 311.

Figure 2:
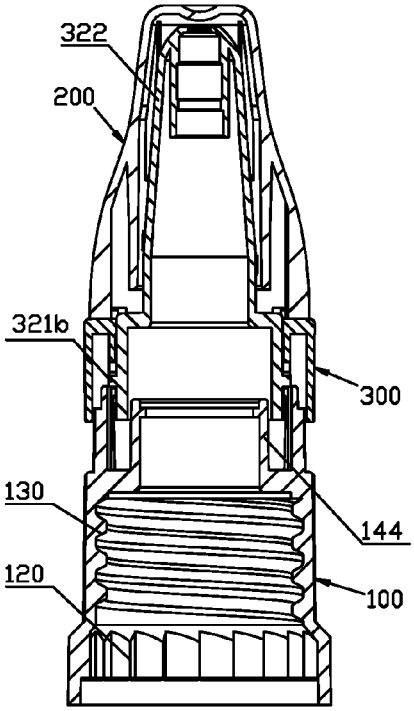
FIG. 2 is shown to a front schematic cross-sectional view of a spray bottle cap in accordance with the present invention.
Figure 3:
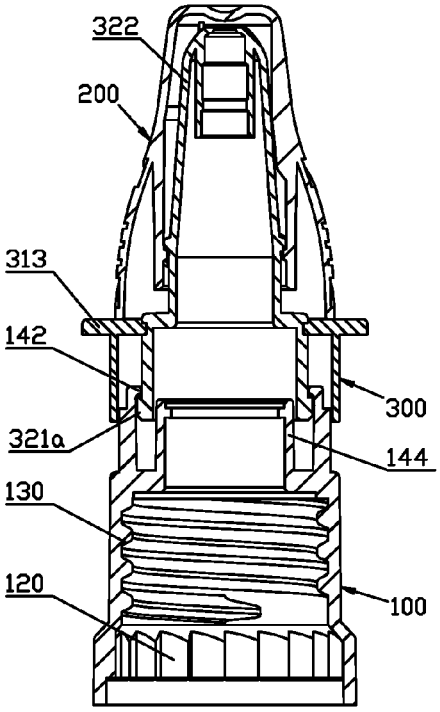
FIG. 3 is shown to a side schematic cross-sectional view of a spray bottle cap in accordance with the present invention.

As shown in FIGS. 1 to 3, the pressing head 300 is arranged above the base lid 100, and the first limit flange 321*a* of the connection portion is arranged below the first limit rib 142 of the base lid. The first guide boss 321*b* of the connection portion is a protrusion portion with a certain width and height, which is located above the first limit rib 142 and deviated away from the first guide groove 143 in a stochastic situation, and fails to move downward by the blocking of the first limit rib 142, so that the pressing head 300 fails to be pressed downward. Only if the first guide boss 321*b* is aligned with the first guide groove 143, the first guide boss 321*b* is up-down slidable along the first guide groove 143 of the base lid, so that the pressing head 300 enables to be pressed downward, by which the first limit rib 142 is circumferentially rotatable between the first guide boss 321*b* and the first limit flange 321*a*. The pressing head 300 is limited by the first limit rib 142 and the first limit flange 321*a* in relative to the axial extension of the base lid 100, and the first positioning boss 145 is matched with the first guide boss 321*b*, so that the pressing head can be positioned in circumferentially rotation in relative to the base lid 100.

As shown in FIG. 3, FIGS. 8*a* to 8*c*, the protective cap 200 is sealed at the upper end, and is in a double-layer structure at the lower end. The protective cap 200 comprises an outer ring 210 and an inner ring 220, where the inner wall of the inner ring 220 of the protective cap is provided with an inner thread 221 fitting with the outer thread of the outlet rod, and an lower end of an inner wall of the outer ring 210 of the protective cap is provided with an anti-reversion snap daughter body 211 matched with the anti-reversion snap parent body 311 of the pressing head 300.

As shown in FIGS. 2 to 6*a*, the assembly method for the pressing head 300 and the base lid 100 is as follows: aligning the first guide boss 321*b* of the pressing head 300 with the first guide groove of the base lid 100; pressing the pressing head 300 towards to the outlet section 140 of the base lid 100, and under the action of the downward pressure, the lower end of the connection portion 330 and the end of the outlet section 140 are transformed, such that the first limit flange 321*a* of the pressing head 300 is slid into the lower part of the first limit rib 142 of the base lid 100, after that, with the loss of external force, the shape of the connection portion 330 of the pressing head 300 and the end of the outlet section 140 are recovered, and the first limit flange 321*a* of the pressing head 300 is stuck by the first limit rib 142 of the base lid 100, such that the pressing head 300 is connected to the base lid 100. For the sake of convenience in assembly, preferably, an upper corner angle of the first limit rib 142 is provided with a chamfer, and a lower corner angle of the first limit flange 321*a* is provided with a chamfer.

Figure 9:
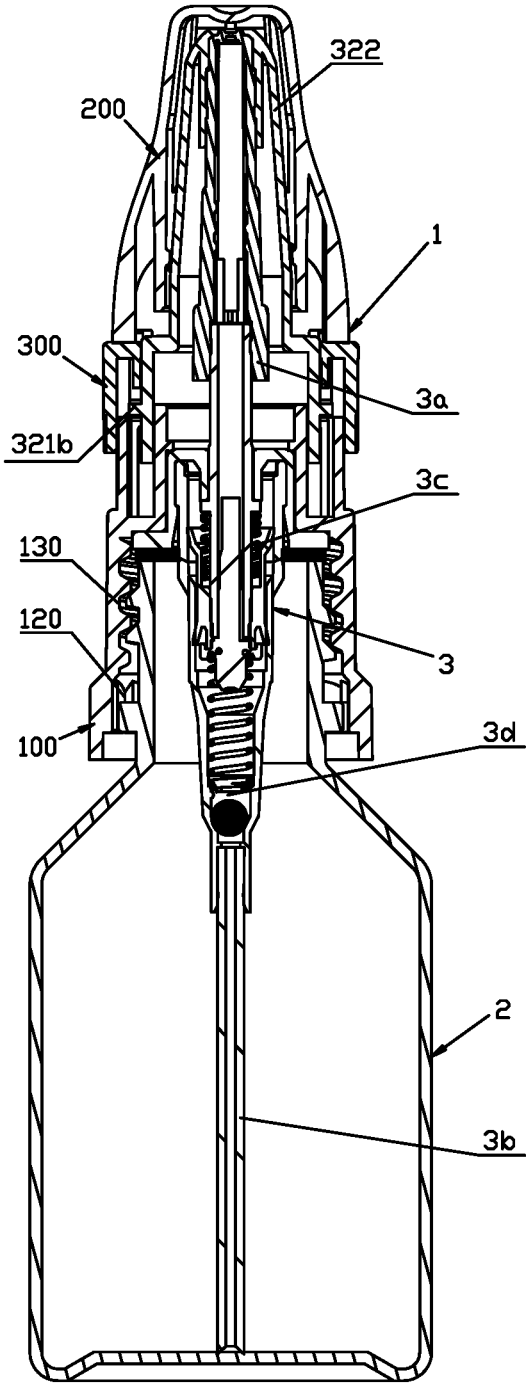
FIG. 9 is shown to a front schematic cross-sectional view of a spray bottle in accordance with the present invention.

As shown in FIG. 9, the spray bottle of the present invention consists of a bottle body 2, a spray bottle cap 1 assembled at the mouth of the bottle body 2, and a sprayer 3. Wherein, the inner thread of the screw hole section 130 of the base lid 100 is matched with the outer thread of the mouth of the bottle body 2, the anti-reversion inner ratchet section 120 of the base lid 100 is matched with the outer ratchet of the mouth of the bottle body 2; the match of the inner and outer ratchets may prevent the reverse rotation of the base lid 100 relative to the mouth of the bottle body 2 such that the base lid 100 is reliably connected to the mouth of the bottle body 2, and is less to disengage. The sprayer 3 is configured between the base lid 100 and the bottle body 2, where the outlet core 3*a* of the sprayer 3 is inserted into the outlet rod 322 of the pressing head 300, and the inlet core 3*b* of the sprayer 3 is inserted to the bottom of the bottle body 2. Inside the sprayer 3 is also provided with a reset spring 3*c*, by which the outlet core 3*a* is in a protruding state, to prevent the liquid in the sprayer 3 returning to the check valve 3*d* inside the bottle body 2.

As shown in FIG. 5*a* to FIG. 9, when the protective cap 200 is in a closing-lid state, the inner thread 221 of the protective cap 200 is tighten with the outer thread 322*a* of the pressing head 300, at this point, the anti-reversion snap daughter body 211 of the protective cap 200 is snap-fit with the anti-reversion snap parent body of the pressing head 300, to limit the reverse rotation of the protective cap 200, so that the protective cap 200 is locked to the pressing head 300 from being less to disengage. At this point, the first guide boss 321*b* of the pressing head 300 is detached from the first guide groove 143 of the base lid 100 and is located above the first limit rib, the side face of the first guide boss 321*b* is contacted with the first positioning boss 145 above the base lid 100, the bottom face of the first guide boss 321*b* placed against the upper head surface of the outlet section 140 of the base lid, such that the pressing head 300 fails to press towards the base lid 100, thereby preventing the liquid leakage in the closed-lid state, with the result of good security. When requiring for extracting liquid, the protective cap 200 is pressed downward, the outer ring 210 of the protective cap 200 is placed against the pressing handle 313 to cause transformation, i.e., the anti-reversion snap daughter body 211 is separated from the anti-reversion snap parent body 311; in the meanwhile, the protective cap 200 is rotated, i.e., the match of threads between the protective cap 200 and the pressing head 300 is loosened, followed by rotating the pressing head 300 until the first guide boss 321*b* is aligned with the first guide groove 143 of the base lid, then the pressing head 300 is pressed downward to make the outlet core 3*a* of the sprayer 3 move downward, so as to realize the spray function of the sprayer 3. As loosening the pressing head 300, under the action of reset spring 3*c*, the outlet core 3*a* is protruded upward for restoration, with the result of driving the pressing head 300 move upward for restoration. During the restoration process of the outlet core 3*a*, the check valve 3*d* in the sprayer is automatically opened under the action of differential pressure, and the liquid in the bottle body 2 enters into the sprayer 3 to realize the internal supplement of liquid. After the liquid spray, the protective cap 200 is retightened to the pressing head 300 by the screw-thread fit until the anti-reversion snap daughter body 211 of the protective cap 200 is slid into the anti-reversion snap parent body 311 of the pressing head 300, to realize the reliable connection between the protective cap 200 and the pressing head 300, and the rotation is not readily to occur as well. In the meanwhile, since the restored first guide boss 321*b* of the pressing head 300 is disconnected with the first guide groove 143 of the base lid under the action of the reset spring 3*c*, the pressing head 300 is rotated along with the protective cap 200, so that the first guide boss 321*b* of the pressing head 300 is placed against the upper head face of the outlet section 140 of the base lid and the first positioning boss 145, to make the pressing head 300 fail to press downward. Accordingly, the spray bottle cap of the present invention is safe, and is labor-saving and convenient in operation, which is easy to use for olds.

For the sake of integral aesthetic appearance and structural reliability of the spray bottle, preferably, the side wall of the connection portion 330 is double-layer structure comprising an outer ring 312 and an inner ring 321, and the first limit flange 321*a* is arranged at a lower end of the inner ring 321; also, the first guide boss 321*b* is arranged at the outer wall of the inner ring 321, and is located above the first limit flange 321*a*. The inner wall of the outer ring 312 of the connection portion 330 is matched with the outer wall of the outlet section 140.

Figure 6A:
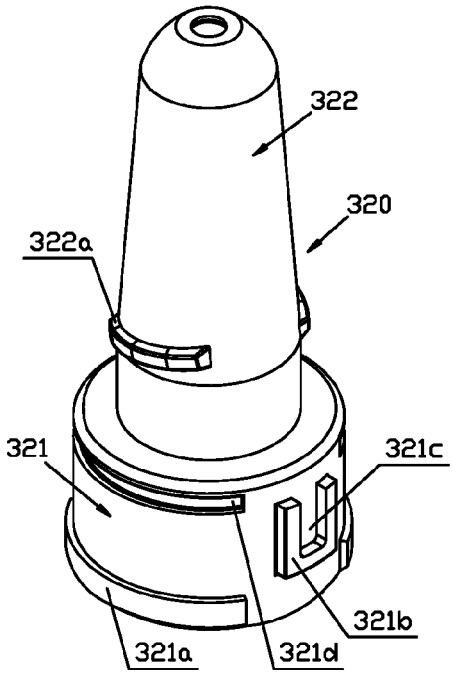
FIG. 6*a* is shown to a schematic perspective view of a pressing head body of a spray bottle cap in accordance with the present invention.
Figure 6B:
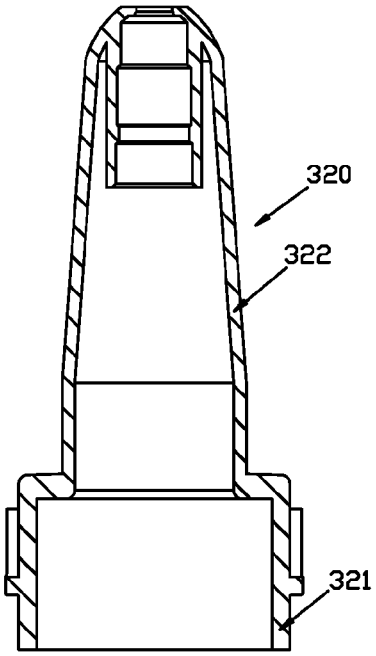
FIG. 6*b* is shown to a front schematic cross-sectional view of a pressing head body of a spray bottle cap in accordance with the present invention.
Figure 6C:
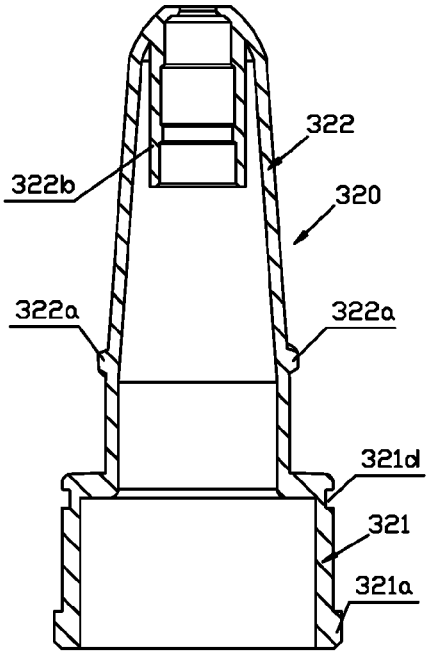
FIG. 6*c* is shown to a side schematic cross-sectional view of a pressing head body of a spray bottle cap in accordance with the present invention.
Figure 7A:
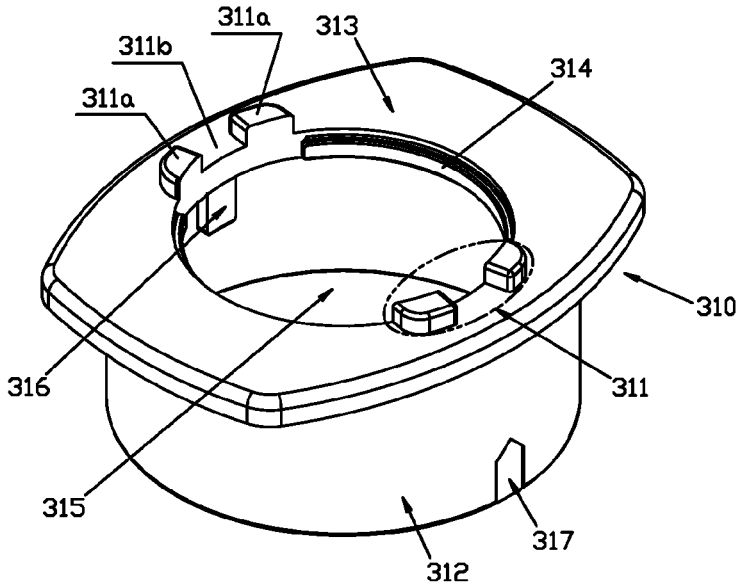
FIG. 7*a* is shown to a schematic perspective view of a bearing seat of a spray bottle cap in accordance with the present invention.
Figure 7B:
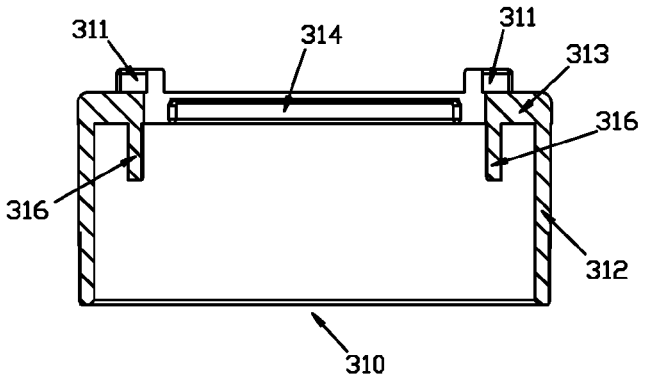
FIG. 7*b* is shown to a front schematic cross-sectional view of a bearing seat of a spray bottle cap in accordance with the present invention.
Figure 7C:
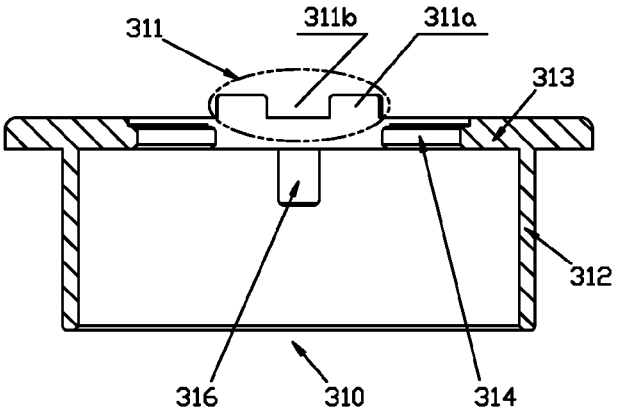
FIG. 7*c* is shown to a side schematic cross-sectional view of a bearing seat of a spray bottle cap in accordance with the present invention.

For facilitating the manufacture and shaping of the pressing head 300, to lower the manufacturing cost thereof, as shown in FIG. 5*a* to FIG. 7*c*, the pressing head 300 adopts a split-type structure, comprising a pressing head body 320 and a bearing seat 310. As shown in FIG. 6*a* to FIG. 6*c*, both the outlet rod 322 and the inner ring 321 of the connection portion are located on the pressing head body 320, wherein, the first guide boss 321*b* of the inner ring 321 of the connection portion is provided with a first positioning groove 321*c* with a upward opening, and the upper end of the outer wall of the inner ring of the connection portion is provided with a second positioning groove 321*d*. As shown in FIG. 7*a* to FIG. 7*c*, both the outer ring 312 of the connection portion and the pressing handle 313 are located on the bearing seat 310, where the pressing handle 313 is provided with a center hole 315 matched with the inner ring 321 of the connection portion, while below the pressing handle 313 is provided with a second positioning boss 316, which is downward extended from the position closed to the edge of the centre hole 315, and is located between the inner ring 321 and the outer ring 312 of the connection portion. The hole wall of the centre hole 315 of the pressing handle is provided with a first positioning rib 314, which is matched with the second positioning groove 321*d*, to realize the axial positioning between the pressing head body 320 and the bearing seat 310; the second positioning boss 316 is matched with the first positioning groove 321*c*, to realize the circumferential positioning between the pressing head body 320 and the bearing seat 310; as a result, the pressing head body 320 and the bearing seat 310 are fixedly connected. Taking the stable reliability of structure, convenience of assembly and economical efficiency of manufacturing cost into consideration, preferably, each of the first guide boss 321*b* (and the first positioning groove 321*c* thereon), the second positioning groove 321*d*, the second positioning boss 316 and the first positioning rib 314 are designed as two in quantity, and are uniformly distributed along the circumference of the corresponding side wall. Correspondingly, the first guide grooves 143 of the base lid 100 are also preferably two, and are uniformly distributed along the circumference of the side wall of the outlet section 140. Certainly, the number may be designed as one for each, or three for each, or varying numbers, as long as meeting the assembly requirement to form the structure of the abovementioned pressing head 300, and to realize the assembly between the pressing head 300 and the base lid 100. Since the pressing head body 320 and the bearing seat 310 are simple in structure, and may be machined by an injection molding process, thereby being convenient in manufacture and low in cost. For the sake of the convenience of assembly, the lower corner angle of the first positioning rib 314 is provided with a chamfer, and the upper corner angle of the inner ring 321 of the connection portion of the pressing head body 320 is also provided with a chamfer as well. Since the first guide bosses 321*b* are preferably two, for the sake of stable reliability of structure, the first positioning bosses 145 of the base lid 100 are also preferably two, and are uniformly distributed along the circumference of the side wall of the outlet section 140. Certainly, one first positioning boss 145 is allowed to realize the corresponding function.

Figure 8A:
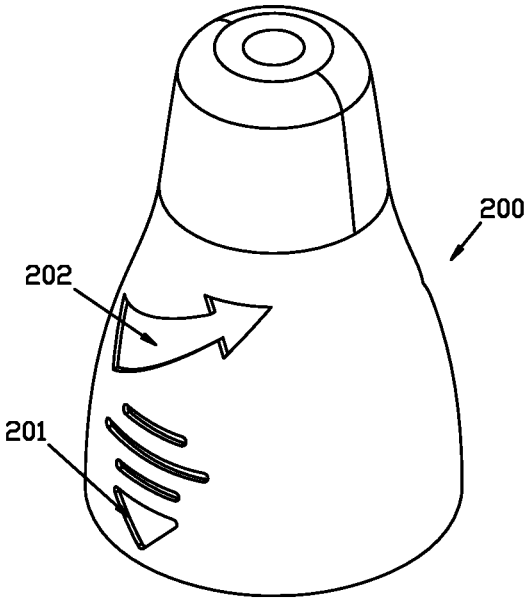
FIG. 8*a* is shown to a schematic perspective view of a protective cap of a spray bottle cap in accordance with the present invention.
Figure 8B:
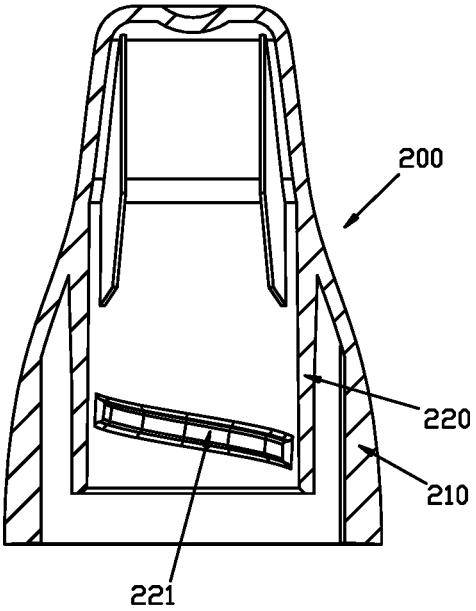
FIG. 8*b* is shown to a front schematic cross-sectional view of a protective cap of a spray bottle cap in accordance with the present invention.
Figure 8C:
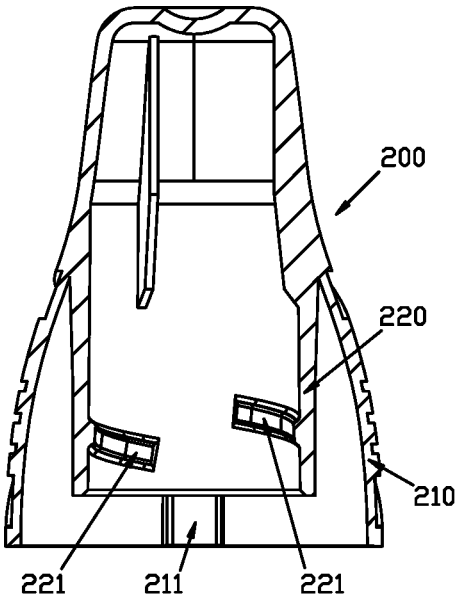
FIG. 8*c* is shown to a side schematic cross-sectional view of a protective cap of a spray bottle cap in accordance with the present invention.

For the sake of convenience in manufacture and shaping and operation, preferably, as shown FIG. 7*a*, the anti-reversion snap parent body 311 is formed of two adjacent bosses 311*a* and a card slot 311*b* therebetween, where the two adjacent bosses 311*a* are configured along the circumference of the periphery of the center hole 315. The two adjacent bosses 311*a* are fan-shape bosses and the outer side (i.e., the side being away from the card slot 311*b*) thereof form arced surfaces. As shown in FIG. 8*c*, the anti-reversion snap daughter body 211 is the boss 211 arranged at the lower end of the inner wall of the outer ring 210 of the protective cap, and the boss 211 can be stuck in the card slot 311*b* along the outward arc of the boss 311*a* during the rotation process along with protection cap, to realize the anti-reversion function. In order to avoid the damage to the matching surface because of relative large resistance during the using process, preferably, corner angles of the boss 211 at both the left and right sides are provided with chamfers. Certainly, the two adjacent bosses 311*a* may be also designed as triangulate bossed, which may make the boss 211 smoothly slide into the card slot 311*b* as well.

As shown in FIG. 4*b*, the outlet section 140 of the base lid 100 is provided with a first neck bush 144, where the lower end of the first neck bush 144 is integrally connected to the lower end of the inner wall of the outlet section 140, and the inner wall of the first neck bush 144 is provided with a ring of sprayer positioning rib 144*a*. Certainly, the first neck bush 144 may also be absent, instead, the base lid 100 is lengthened to design a section of inner side wall matched with the sprayer 3 between the outlet section 140 and the screw hole section 130 of the base lid 100, and the sprayer positioning rib 144*a* is designed on the section of inner side wall, which is also able to meet the requirement of the installment of sprayer 3 as well. As shown in FIG. 6*c*, the outlet port of the outlet rod 322 is provided with a second neck bush 322*b* for connecting to the outlet core 3*a* of the sprayer, and the upper end of the second neck bush 322*b* is integrally connected to the inner wall of the outlet rod 322.

As shown in FIG. 5*a*, the pressing handle 313 is a rectangular-like plate surrounded by four arc-shaped edges. Certainly, the pressing handle 313 may be designed as a circle, a square or a rectangle, as long as the outer ring 210 of the protective cap enables to reliably press thereon to form sufficient transformation, so that the anti-reversion snap daughter body 211 and the anti-reversion snap parent body 311 can be smoothly detached, and can be convenient for fingers to press simultaneously.

For the durable consideration, preferably, the thread matched between the inner ring 220 of the protective cap and the outlet rod 322 has two sections uniformly distributed along the circumference; there are also two anti-reversion snap parent bodies 311 and two anti-reversion snap daughter bodies 211, which are respectively arranged between the two sections of the thread.

After the protective cap 200 is opened to perform liquid extraction, since it is unable to find out the inside situation by eyes, the user may just by feel to determine whether the first guide boss 321*b* of the pressing head 300 is align with the first guide groove 143 of the base lid 100 or not. In order to avoid such inconveniency, preferably, as shown in FIG. 4*a*, the outer wall of the base lid 100 is provided with a first alignment reference mark 141; and as shown in FIG. 5*a*, the outer wall of the connection portion 330 is provided with a second alignment reference mark 317, when performing liquid extraction, the pressing head 300 is rotated to align the second alignment reference mark 317 with the first alignment reference mark 141 of the base lid 100, and then the first guide boss 321*b* of the pressing head 300 is inserted into the first guide groove 143 of the base lid 100 smoothly, with the result of much more convenient in operation. For operation indication, preferably, as shown in FIG. 8*a*, the outer wall of the protection cap 200 is further provided with a pressing mark 201 and a rotation mark 202, to reminder the user to detach the anti-reversion snap by pressing 202, and separate the protection cap 200 from the pressing head 300 by rotation.

FIGS. 10 to 14 are shown to a second embodiment of the spray bottle cap in accordance with the present invention, compared to the first embodiment as shown in FIGS. 1 to 9, the present embodiment mainly has two aspects of improvement.

Figure 10:
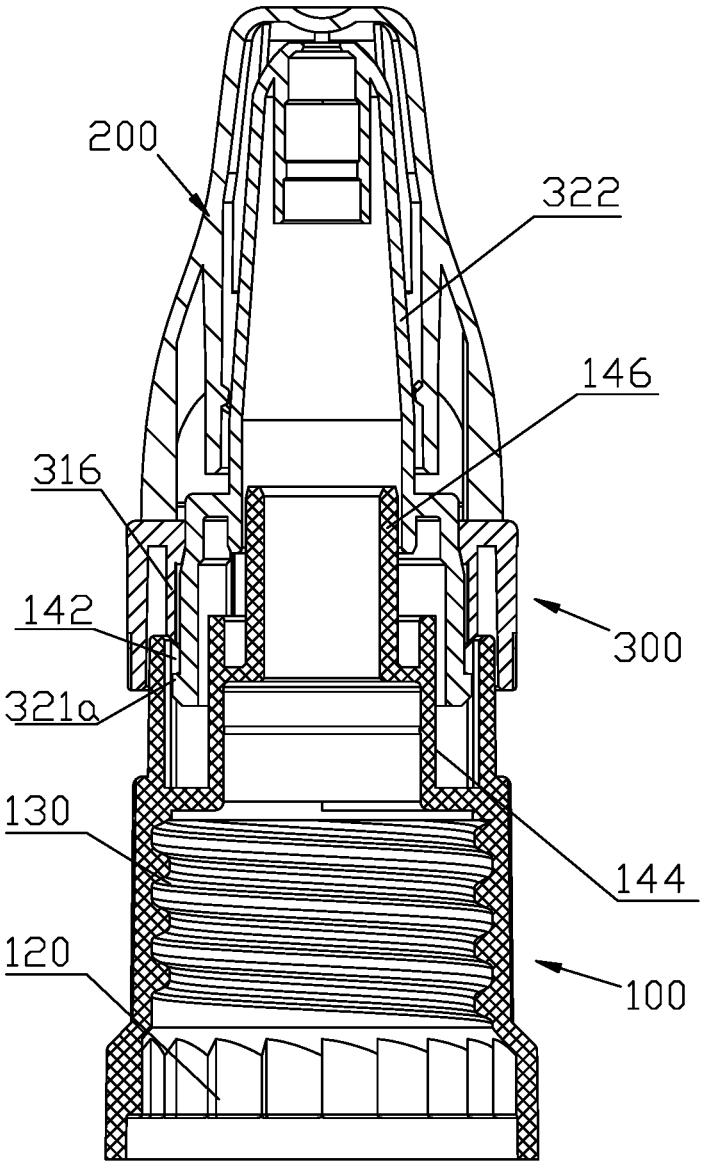
FIG. 10 is shown to a schematic cross-sectional view of a spray bottle cap of the second embodiment in accordance with the present invention.
Figure 11:
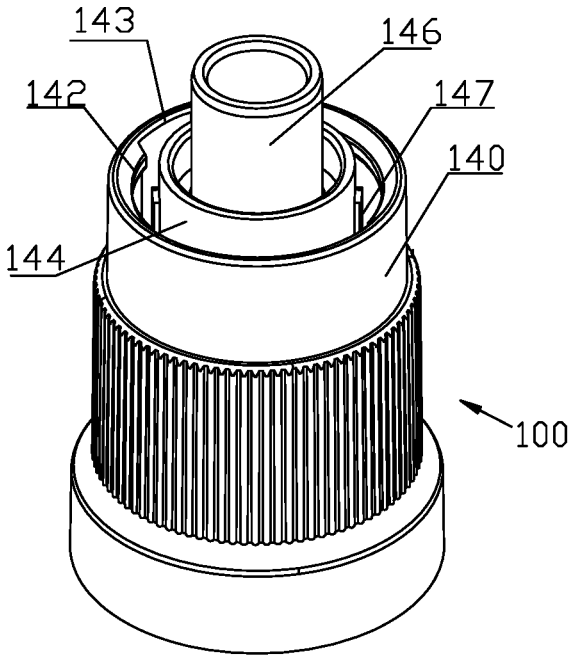
FIG. 11 is shown to a schematic perspective view of a base lid of the second embodiment in accordance with the present invention.
Figure 12:
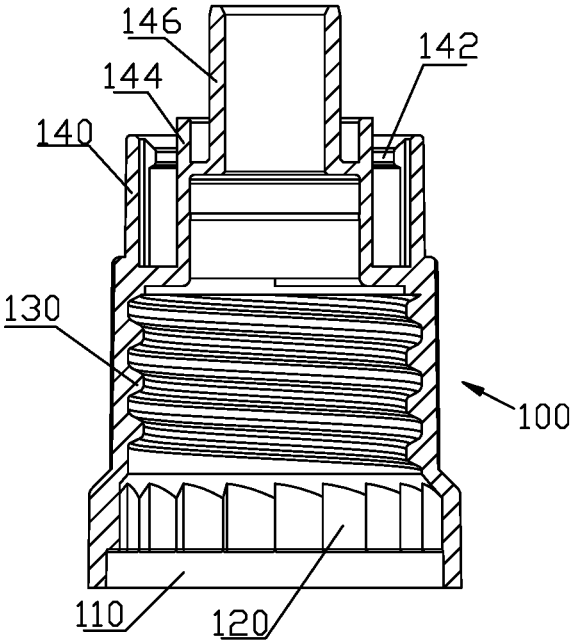
FIG. 12 is shown to a schematic cross-sectional view of a base lid of the second embodiment in accordance with the present invention.
Figure 13:
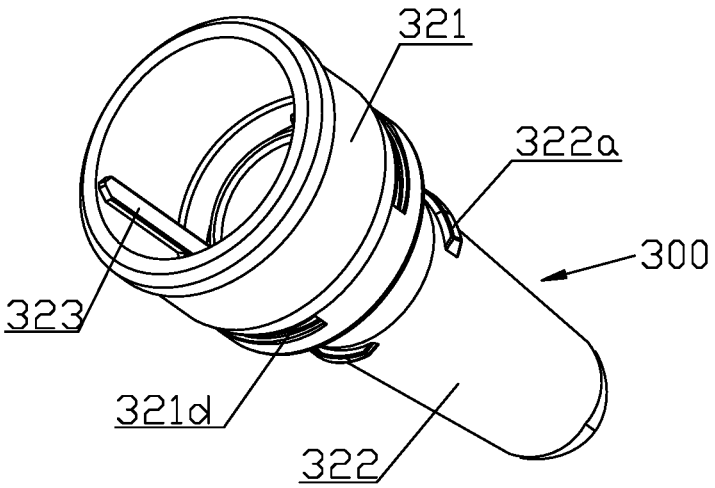
FIG. 13 is shown to a schematic perspective view of a pressing head body of the second embodiment in accordance with the present invention.

On the one hand, as shown in FIG. 10 to FIG. 12, inside the first neck bush 144 of the base lid 100 is further provided with a length of guide bush 146 extended upward, a lower end of the guide bush 146 is integrally connected to the inner wall of the first neck bush 144, and an upper end of the guide bush 146 is inserted in an inner cavity of the outlet rod 322. As such, the guide bush 146 may form a guide support to the pressing head, so that the pressing head is resistant to snap during the pressing process.

Figure 14:
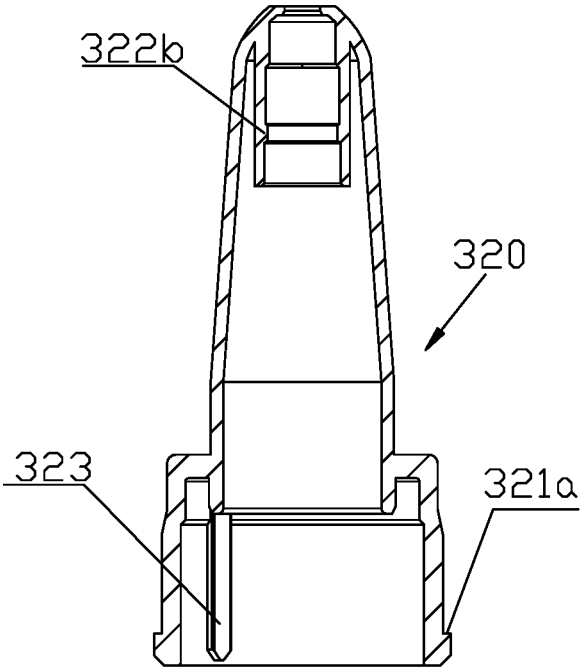
FIG. 14 is shown to a schematic cross-sectional view of a pressing head body of the second embodiment in accordance with the present invention.

On the other hand, as shown in FIG. 10 to FIG. 14, the first guide boss 321*b* (as shown in FIG. 6*a*) and the first positioning boss 145 (as shown in FIG. 4*a*) at the upper end face of the outlet section 140 of the base lid are cancelled in the present embodiment. In the present embodiment, the first guide boss 321*b* is substituted by the second positioning boss 316 (as shown in FIG. 7*a*) between the inner ring and outer ring of the connection portion of the pressing head as a protrusion portion. As shown in FIG. 10, the second positioning boss 316 is located above the first limit rib 142 and deviated away from the first guide groove 143 in a stochastic situation, and fails to move downward by the blocking of the first limit rib 142, so that the pressing head 300 fails to be pressed downward. Only if the second positioning boss 316 is aligned with the first guide groove 143 of the base lid, the second positioning boss 316 is up-down slidable along the first guide groove 143, so that the pressing head 300 enables to be pressed downward. More preferably, the outer wall of the first neck bush 144 is provided with a third positioning boss 147 (as shown in FIG. 11), and the inner wall of the pressing head 300 is provided with a fourth positioning boss 323 (as shown in FIG. 14); when the pressing head 300 is un-pressed, the pressing head 300 is rotating against the base lid 100, and the fourth positioning boss is placed against the third positioning boss, and thus the rotation may no longer proceed. At this point, the protrusion portion (i.e., the second positioning boss 316) is located at the position deviated away from the first guide groove 143, by such, the pressing head 300 fails to be pressed, thereby preventing the press of the pressing head 300 by misoperation in the non-use state of the spray bottle, so as to decrease the probability of liquid leakage.

In summary, the spray bottle and the bottle cap of the present invention have good security, avoid to be inadvertently opened and accidental ingested by infants, and is labor-saving and convenience in operation, and easy for olds as well. Therefore, the present invention effectively overcomes a variety of disadvantages in the prior art and has high industrial utility value.

The abovementioned embodiments only illustratively describe the principle and efficacy of the present invention, rather than being used to limit the present invention. Any person skilled in the art may modify or amend the abovementioned embodiments without departing from the spirit and scope of the present invention. Thus, all equivalent modifications or amendments accomplished by persons having common knowledge in the technical field concerned without departing from the spirit and technical thoughts revealed by the present invention shall still be covered by the claims of the present invention.

What is claimed is:

1. A spray bottle cap comprising:

a base lid (100), an upper end of an inner wall of the base lid (100) is provided with a first limit rib (142) and a first guide groove (143) penetrating the first limit rib;

a pressing head (300) connecting to the upper end of the base lid (100); the pressing head (300) comprises a outlet rod (322), a pressing handle (313) and a connection portion (330), the outer wall of the outlet rod (322) is provided with an outer thread (322*a*); inside the connection portion (330) is provided with a first limit flange (321*a*) and a protrusion portion (321*b*, 316), the protrusion portion (321*b*, 316) is located above the first limit flange (321*a*); the pressing handle (313) is provided with an anti-reversion snap parent body (311); the first limit flange (321*a*) of the connection portion (330) is arranged under the first limit rib (142) of the base lid (100), the protrusion portion (321*b*, 316) is up-down slidable along the first guide groove (143) of the base lid (100);

a protective cap (200) covering the outside of the outlet rod (322); a lower end of the protective cap (200) is a double-layer structure comprising an outer ring of the protective cap (210) and an inner ring of the protective cap (220); an inner wall of the inner ring of the protective cap (220) is provided with an inner thread (221) matched with the outer thread (322*a*) of the outlet rod (322), and an lower end of an inner wall of the outer ring of the protective cap (210) is provided with an anti-reversion snap daughter body (211) matched with the anti-reversion snap parent body (311).

2. The spray bottle cap according to claim 1, characterized in that, a side wall of the connection portion (330) is double-layer structure comprising an outer ring of the connection portion (312) and an inner ring of the connection portion (321), the first limit flange (321*a*) is arranged at a lower end of the inner ring of the connection portion (321).

3. The spray bottle cap according to claim 2, characterized in that, the protrusion portion is the first guide boss (321*b*) arranged at the outer wall of the inner ring of the connection portion (321).

4. The spray bottle cap according to claim 3, characterized in that, an upper head face of the base lid (100) is provided with a first positioning boss (145), where the first positioning boss (145) and the first guide groove (143) are arranged in a same circumference.

5. The spray bottle cap according to claim 1, characterized in that, the pressing head (300) is a split-type structure, which consists of a pressing head body (320) and a bearing seat (310).

6. The spray bottle cap according to claim 1, characterized in that, the anti-reversion snap parent body (311) is formed by two adjacent bosses (311*a*) and a card slot (311*b*) located between the two bosses (311*a*), where the two adjacent bosses (311) are arranged in a circumferential direction; the anti-reversion snap daughter body (211) is the boss (211) arranged at the lower end of the inner wall of the outer ring (210) of the protective cap (200), and the boss (211) is matched with the card slot (311*b*).

7. The spray bottle cap according to claim 6, characterized in that, the two adjacent bosses (311*a*) are fan-shape bosses, and the side faces of the two adjacent bosses (311*a*) being away from the card slot (311*b*) are arced surfaces.

8. The spray bottle cap according to claim 1, characterized in that, an upper corner angle of the first limit rib (142) is provided with a chamfer, and a lower corner angle of the first limit flange (321*a*) is provided with a chamfer.

9. The spray bottle cap according to claim 1, characterized in that, the inner wall of the base lid (100) is a shape of stepped holes of lower large-upper small, and comprises a light aperture section (110), an anti-reversion inner ratchet section (120), a screw hole section (130) and an outlet section (140) from the lower to the upper side.

10. The spray bottle cap according to claim 9, characterized in that, inside the outlet section (140) is provided with a first neck bushing (144), where the lower end of the first neck bush (144) is integrally connected to the lower end of the outlet section (140), and an inner wall of the first neck bush (144) is provided with a ring of sprayer positioning rib (144*a*).

11. The spray bottle cap according to claim 10, characterized in that, an outer wall of the first neck bush (144) is provided with a third positioning boss (147), and the inner wall of the pressing head (300) is provided with a fourth positioning boss (323); when the pressing head (300) is rotating against the base lid, the fourth positioning boss (323) is placed against the third positioning boss (147).

12. The spray bottle cap according to claim 10, characterized in that, inside the first neck bush (144) is further provided with a length of guide bush (146) extended upward, a lower end of the guide bush (146) is integrally connected to the inner wall of the first neck bush (144), and an upper end of the guide bush (146) is inserted in an inner cavity of the outlet rod (322).

13. The spray bottle cap according to claim 1, characterized in that, inside the outlet port of the outlet rod (322) is provided a second neck bush (322*b*) for connecting to an outlet core of the sprayer, and an upper end of the second neck bush (322*b*) is integrally connected to the inner wall of the outlet rod (322).

14. The spray bottle cap according to claim 1, characterized in that, the outer wall of the base lid (100) is provided with a first alignment reference mark (141) and the outer wall of the connection portion (330) is also provided with a second alignment reference mark (317).

15. The spray bottle cap according to claim 1, characterized in that, the thread matched between the inner ring of the protective cap (220) and the outlet rod (322) has two sections uniformly distributed along the circumference; there are two anti-reversion snap parent bodies (311) and two anti-reversion snap daughter bodies (211), which are respectively arranged between the two sections of the threads.

16. The spray bottle cap according to claim 1, characterized in that, the protrusion portion further may be the second positioning boss (316) arranged between the inner ring (321) and the outer ring (312) of the connection portion.

17. A spray bottle comprising a bottle body (2) and a sprayer (3), characterized in that, the bottle body (2) is connected with the spray bottle cap (1) according to claim 1.

* * * * *